US005175028A

United States Patent [19]

Tanaka et al.

[11] Patent Number: 5,175,028

[45] Date of Patent: Dec. 29, 1992

[54] METHOD OF FORMING LAYERS ON A SUPPORT

[75] Inventors: Takeshi Tanaka; Hitoshi Mitake; Shigeru Kobayashi, all of Hino, Japan

[73] Assignee: Konica Corporation, Tokyo, Japan

[21] Appl. No.: 893,565

[22] Filed: Jun. 3, 1992

Related U.S. Application Data

[63] Continuation of Ser. No. 644,118, Jan. 18, 1991, abandoned.

[30] Foreign Application Priority Data

Jan. 23, 1990 [JP] Japan ..... 2-14563

[51] Int. Cl.[5] ..... B05D 1/34

[52] U.S. Cl. ..... 427/407.1; 427/409; 427/412; 427/412.2; 427/412.3; 427/412.5; 427/419.8; 427/420

[58] Field of Search ..... 427/209, 338, 359, 407.1, 427/412.2, 412.3, 412.5, 420, 333, 409, 412, 419.8

[56] References Cited

U.S. PATENT DOCUMENTS

| | | | |
|---|---|---|---|
| 2,932,855 | 4/1960 | Bartlett et al. | 427/209 |
| 3,498,824 | 3/1970 | Chadha | 427/407.1 |
| 3,958,050 | 5/1976 | Stauner et al. | 427/333 |
| 4,241,171 | 12/1980 | Clapp et al. | 427/333 |
| 4,369,231 | 1/1983 | West et al. | 427/209 |
| 4,431,472 | 2/1984 | Höhl et al. | 156/307.3 |
| 4,435,241 | 3/1984 | Corbett | 427/412.3 |
| 4,569,863 | 2/1986 | Koepke et al. | 427/402 |
| 4,618,389 | 10/1986 | Agodoa | 427/407.1 |
| 4,623,501 | 11/1986 | Ishizaki | 427/412.3 |
| 4,743,527 | 5/1988 | Yoshida et al. | 430/272 |
| 4,863,765 | 9/1989 | Ishizuka | 427/420 |
| 4,942,068 | 7/1990 | Schweicher et al. | 427/420 |

*Primary Examiner*—Michael Lusignan
*Assistant Examiner*—Diana Dudash
*Attorney, Agent, or Firm*—Frishauf, Holtz, Goodman & Woodward

[57] ABSTRACT

A method of coating a first resin solution containing a polymerization inducer on a moving web-like support with a coating device, comprising conveying the support to pass near the coating device without coming in contact with the coating device, disposing the first resin solution in a form of a first resin solution layer from the coating device onto the support; the first resin solution layer having a lower surface which faces the support and an upper surface opposite to the lower surface; and the coating device having a first release point at which the upper surface leaves the coating device and a second release point at which the lower surface leaves the coating device; overlaying the first release point with a solvent, thereby superimposing a solvent layer on the upper surface of the first resin solution layer; overlaying the second release point with a second resin solution which does not contain a polymerization inducer, thereby superimposing a second resin solution layer on the lower surface of the first resin solution layer; and applying the superimposed layers onto the support so that the solvent layer forms an uppermost layer on the support.

19 Claims, 3 Drawing Sheets

METHOD OF FORMING LAYERS ON A SUPPORT

This application is a continuation of application Ser. No. 07/644,118, filed Jan. 18, 1991, now abandoned.

BACKGROUND OF THE INVENTION

The present invention relates to a method of coating a resin solution which is hardened by polymerization.

Conventionally, the slide hopper-type, the extruder-type and the Giesser-type coating apparatus, each equipped with a liquid-spouting slit and/or a liquid-releasing edge, have been employed for the continuous application of a coating liquid onto the surface of a support web. However, the use of these apparatus encounters such a problem that a coating liquid may adhere to the periphery of the liquid-spouting slit and/or the liquid-releasing edge due to its stagnation, wetting and creeping back flow when continuously applied onto the surface of a support web, and solidify there with the lapse of time. When a coating liquid comprises a hardenable resin, this phenomenon causes serious coating streak trouble, and eventually leads to significantly lowered productivity and poor product quality.

The adhering coating liquid, which is hardened by polymerization, is too hard to be removed by washing with water or wiping off with a solvent. Shaving-off with a knife is the only effective way to remove it, but, to avoid a risk that a coating apparatus which is shaped precisely gets scratches, such shaving must be done carefully taking a long period of time.

The coating of a resin solution which is hardened by polymerization is always accompanied by coating streak trouble, that is of a cause entirely different from a similar comet-like longitudinal streak trouble which is caused by the slower flow of solid particles when an ununiform coating liquid obtained by suspending the solid particles is applied. This trouble cannot be avoided by adjusting coating conditions such as the viscosity of a coating liquid or by controlling the fluctuations of a web.

SUMMARY OF THE INVENTION

The object of the present invention is to provide a method of preventing the adhesion of a stuck solid resin to the periphery of a liquid-spouting slit and/or a liquid-releasing edge of the coating head in the continuous application of a resin solution that is adjusted to be hardenable by the addition of a polymerization inducer, such as a polymerization catalyst, a polymerization initiator and a cross-linking agent, which stuck solid resin is formed by the solidification of said resin solution.

Another object of the invention is to provide a technique for avoiding longitudinal streak trouble in a coating layer of said resin solution.

The above objects can be achieved by the following method that is, when at least one layer is provided on a support by preparing a uniform solution of a resin which is polymerized to solidify by the action of a polymerization inducer, which serves to activate a polymerization system prior to polymerization, coating a solvent film layer is performed on the upper surface of the coating film layer of said uniform solution, which is adjusted to be hardenable, and coating a film layer of a resin solution which is adjusted to be unhardenable on the lower surface of the coating film layer of said hardenable resin solution, according to a multiple casting process.

In the invention, the expression "adjusted to be unhardenable" means such a condition that a polymerization inducer does not take effect, and more specifically, means the absence of a polymerization inducer, or, in the case of a composite polymerization inducer which will be explained later, means the absence of one or all of elemental polymerization inducer.

DETAILED DESCRIPTION OF THE INVENTION

Figure 1:
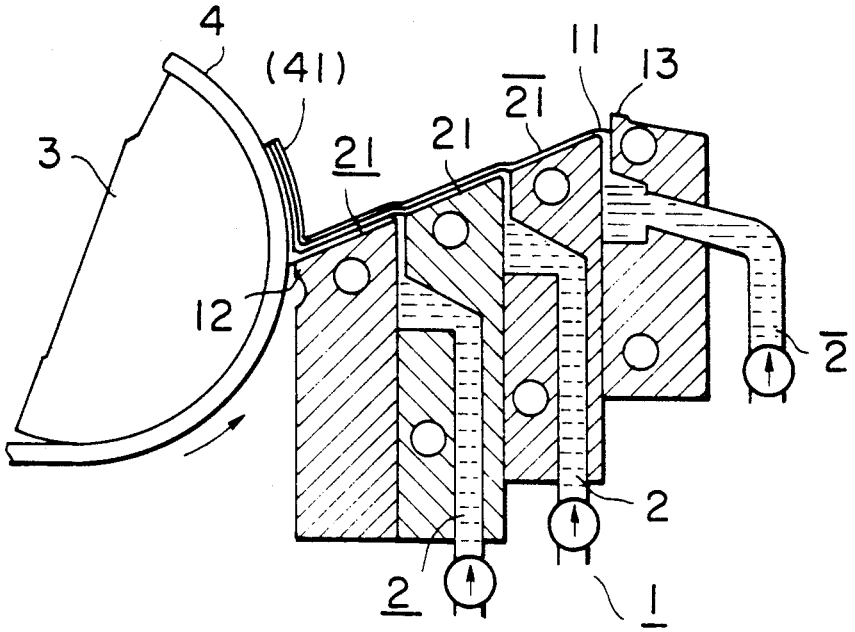
FIG. 1 illustrates one embodiment of the present invention in which a multi-layer coating is performed with a slide hopper type coater.

Generally, polymerization can be classified into radical (free radical) polymerization and ion polymerization (cation and anion polymerization) in respect of the dynamics of polymerization, and into addition polymerization, copolymerization and condensation polymerization with respect to the manner of polymerization.

Polymers obtained by polymerization can be divided into unidimensional chain-like or branched polymers and three-dimensional cross-linked (net-like) polymers in regard to the shape of molecules.

The three-dimensional cross-linked polymers can be divided into net-like polymers in which the molecules of unidimensional polymers are directly linked to each other at their active sites and cross-linked polymers in which a bridging molecule chain is present between the molecules of unidimensional polymers.

Various agents are employed in a polymerization system that will produce a polymer (resin) with a prescribed shape by the above-mentioned polymerization dynamics or in the above-mentioned manner of polymerization.

Such agents include polymerization catalysts which serve to activate a polymerization system and put it in polymerization mechanism without being consumed in a normal state; polymerization (chain reaction) initiators which serve to allow polymerization to proceed with themselves being consumed and decomposed into radicals; and polymerization promoters which serve to promote the decomposition of initiators into radicals with themselves being consumed. The polymerization initiators and promoters, which are consumed during polymerization, and are occasionally taken into a resin formed, should be distinguished from the polymerization catalysts.

The mechanism of these agents in radical, cation or anion polymerization has not yet been fully elucidated. Further, it is hard to draw an exact line among these agents in view of various conflicting viewpoints as to the activity of these agents and the ambiguity of terminology, in addition to the fact that there are cases where polymerization initiates and proceeds by the action of at least two of these agents compensating for one another.

Therefore, in the invention, such agents as polymerization catalysts, polymerization (chain reaction) initiators and polymerization promoters will be referred to as "polymerization inducer" and a group of two or more of these agents which is involved in polymerization by their combined effects will be referred to as a "composite polymerization inducer" for convenience sake.

In contrast to the preceding polymerization inducer, there are agents that suppress polymerization, such as polymerization inhibitors that retard a reaction; polymerization prohibitors that prevent a reaction from initiating for a while (induction period) and then allow the reaction to proceed as they are consumed; and polymerization regulators that control the molecular weight of a polymer without changing the velocity of polymerization.

"Cross-linking agents" generally mean agents that form a bridging molecule between the molecules of a chain-like polymer. In the present invention, such cross-linking agents, as well as agents that directly link the molecules of a chain-like polymer to form a net-like polymer, will be included in the preceding polymerization inducers.

Usable cross-linking agents include divinyl compounds, diallyl compounds that are employed for the polymerization of vinyl monomers under the mechanism of radical polymerization; aldehydes, dialdehydes, urea derivatives, glycols, dicarboxylic acids, monoamines and diamines which permit the condensation cross-linkage reaction of the polymers having active hydrogen such as hydroxyl, amino and carboxyl radicals under the mechanism of ion polymerization; and diisocyanates, bisepoxy compounds and bisethylene imine compounds which permit the cross-linkage of the above polymers in a manner of the addition polymerization.

The present invention is aimed at eliminating coating trouble ascribable to the hardening of a resin solution which is caused with the lapse of time by the action of the aforementioned polymerization inducer.

The coating apparatus to be employed in the invention include Giessers, extruders, slide hoppers and curtain flow-type apparatus.

Figure 3:
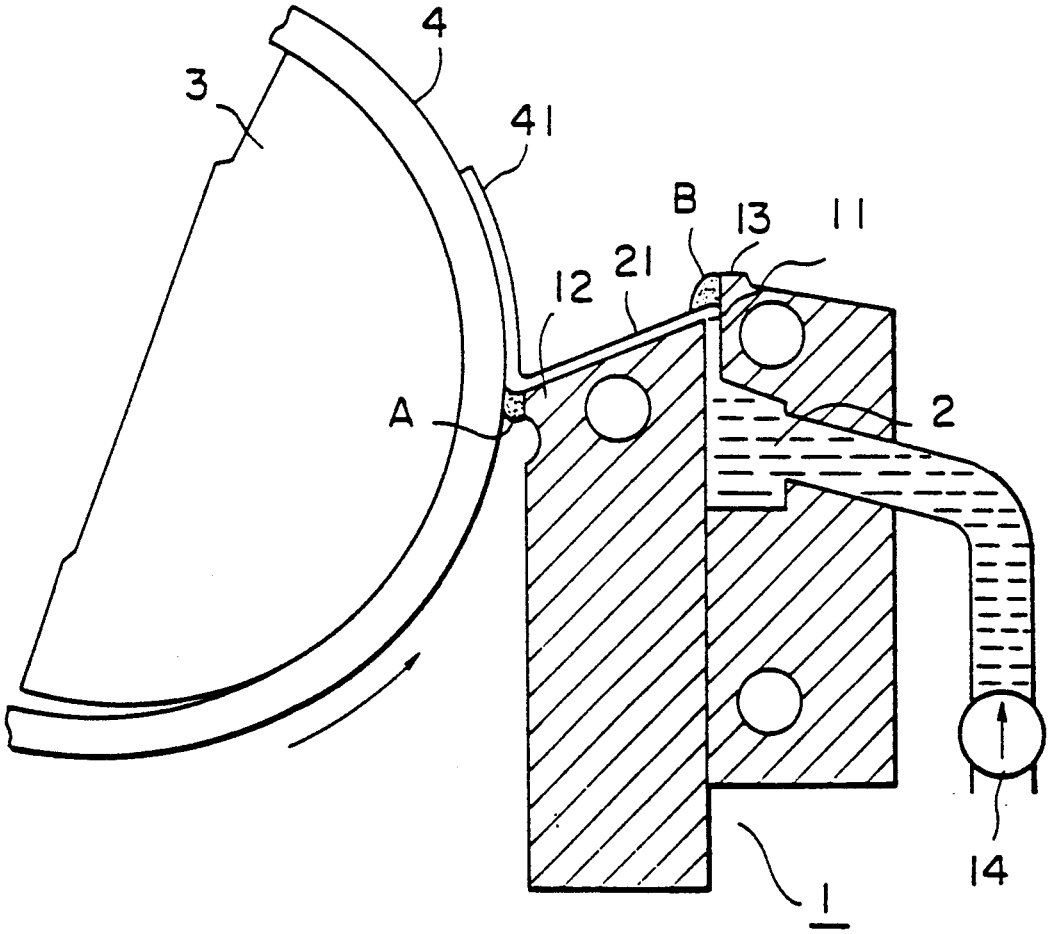
FIG. 3 PRIOR ART
FIGS. 3 and 4 respectively illustrate the conventional coating process of a slide hopper type and an extruder type, showing the formation process of a stuck resin solid.

FIG. 3 shows the conventional manner of multi-layer coating by means of a slide hopper.

Numeral 1 designates a hopper, 11 a liquid-spouting slit, 12 a liquid-releasing edge, 13 a ridge to prevent the overflow of a coating liquid, 14 a liquid-extruding pump, 2 a hardenable resin solution, 21 a coating film layer running down the slide surface, 3 a backing roll, 4 a support web backed by the roll, and 41 a coated layer formed on the web.

"A" designates a resin solid stuck at the bead forming part of the edge 12, which is formed by the hardening of the resin solution. "B" also designates a resin solid stuck at the ridge 13. In the case of "B", the resin solution climbs up the ridge 13 while wetting the ridge, and solidifies there with the lapse of time. In a slide hopper type coating, both sides of a coating film layer are subject to cause longitudinal streak trouble, and the longitudinal streaks formed by "B" can hardly be cured by self-restoration.

Figure 4:
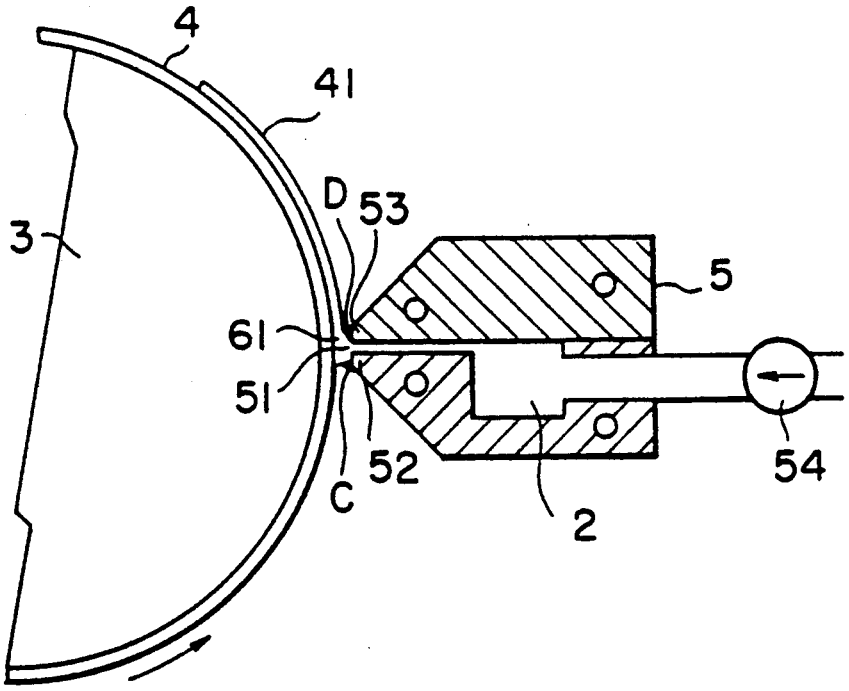
FIG. 4 PRIOR ART

FIG. 4 illustrates the conventional manner of coating by means of an extruder.

Numeral 5 designates an extruder head, 51 a liquid-spouting slit, 52 a edge at the up stream side, 53 a edge at the down stream side, 61 a bead formed between a support web and the end of the extruder head, 3 a backing roll, 4 a support web backed up by the roll 3, and 41 a coated layer formed on the web.

"C" designates a resin solid stuck at the bead portion of the edge 52, which is extruded from the hardening of the resin solution. "D" also designates a resin solid stuck at the liquid-releasing point of the read edge 53 in the bead portion. Like a slide hopper, both sides of a coating film layer formed by an extruder head are also subject to cause longitudinal streak trouble. Further, since the stuck resin solid is formed in a small opening between the end of the extruder and the web, the formation of a large stuck resin solid may not only cause the longitudinal streak trouble, but also may do damage to the support web.

To solve the above problem, in the present invention, the upper and lower sides of a coating film layer of a resin solution which is adjusted to be hardenable by the addition of a polymerization inducer are respectively brought into contact with a coating film layer of a solvent and that of a resin solution which is adjusted to be unhardenable, so that said hardenable resin solution is prevented from touching a liquid-releasing edge and/or a ridge where said hardenable resin solution tends to adhere and solidify with the lapse of time.

FIG. 1 shows one embodiment of the present invention in which a slide hopper type coater is employed. In FIGS. 1 and 3, the same numeral has the same meaning.

In FIG. 1, numeral 2 designates a resin solution adjusted to be hardenable, 21 a coating film layer running down the slide surface, $\overline{2}$ a solvent, $\underline{2}$ a resin solution adjusted to be unhardenable, $\overline{21}$ a coating film layer of $\overline{2}$ in contact with the upper surface of 21, $\underline{21}$ a coating film layer of $\underline{2}$ in contact with the lower surface of $\underline{21}$, and (41) a coated layer having multi-layer formed on a web 4 and consisting of coating film layers $\overline{21}$, 21 and $\underline{21}$.

Figure 2:
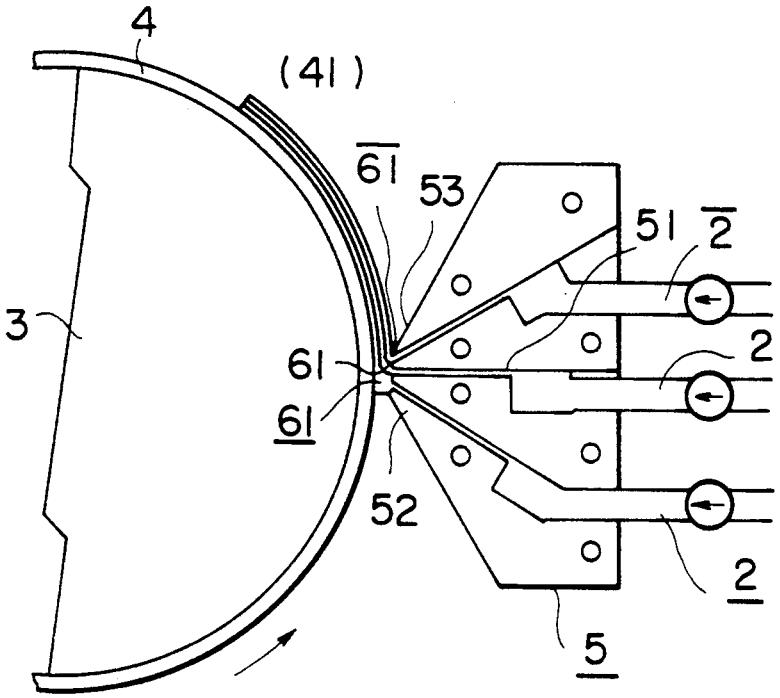
FIG. 2 illustrate another embodiment of the present invention in which a multi-layer coating is performed with an extruder type coater.

FIG. 2 shows another embodiment of the invention in which an extruder is employed.

Numeral 61 is a bead of a resin solution adjusted to be hardenable, $\overline{61}$ a bead of a solvent $\overline{2}$ in contact with the upper side of the bead 61, $\underline{61}$ a bead of a resin solution $\underline{2}$ adjusted to be unhardenable being in contact with the lower side of the bead 61.

A coating film layer of the hardenable resin solution may be of either a single-layer or a multi-layer structure. In the case of a multi-layer structure, the layer may consist of layers of different kinds of resin.

As to the solvents to be added to the preceding resin solution, the solvents to be employed for diluting the resin solution to form a coating liquid, and the solvents to be employed for forming a coating film layer which will be brought into contact with a coating film layer of the hardenable resin solution, can be chosen from ketones such as acetone, methyl ethyl ketone, methyl isobutyl ketone and cyclohexanone; alcohols such as methanol, ethanol, propanol and butanol; esters such as methyl acetate, ethyl acetate, butyl acetate, ethyl lactate and ethylene glycol monoacetate; ethers such as glycol dimethyl ether, glycol monoethyl ether, dioxane and tetrahydrofuran; aromatic hydrocarbons such as benzene, toluene and xylene; halogenated hydrocarbons such as methylene chloride, ethylene chloride, carbon tetrachloride, chloroform and dichlorobenzene.

In case that a used resin is water soluble, water or a solvent mixed with water may be used as the above solvents.

Usable supports include polyesters such as polyethylene terephthalate and polyethylene-2,6-naphthalate; polyolefins such as polypropylene; cellulose derivatives such as cellulose triacetate and cellulose diacetate; and plastics such as polyamide and polycarbonate. Also usable are metals such as Cu, Al and Zn, glass, BN, Si carbide and ceramics.

When the present invention is applied to a pre-sensitized (PS) plate, a support of an aluminum plate or an anodic oxidized aluminum plate can be preferably employed.

The present invention is advantageous for producing a pre-sensitized plate, in particular, a waterless printing plate of a multi-layer structure. A waterless printing plate can be obtained by providing layers of the following constitution on a support.

That is, a primer layer, a light-sensitive layer and a silicone rubber layer are provided on a support in this sequence from the supportside. It is preferred that the primer layer contains a diazo resin and a hydroxyl group-containing polymer and can be hardened by light exposure before the provision of a light-sensitive layer.

A light-sensitive layer is provided on the primer layer. Any substance may be employed as long as its solubility in a developer changes before and after exposure.

The examples of a light-sensitive layer are a layer of a substance which is soluble in a developer when exposed to light, such as o-quinonediazo compounds and o-nitrobenzyl carbinol ester compounds, and a layer of a substance which is insoluble in a developer when exposed to light, such as diazo compounds and compounds containing an addition-polymerizable vinyl group. Besides the above substances, it is possible to add to a light-sensitive layer a dye, a pigment, an exposed part visualizing agent and a coatability improving agent to improve development image visualizing property, exposure image visualizing property and coatability.

The amount per surface area of a light-sensitive layer is preferably 0.1 to 30 mg/dm$^2$, more preferably, 0.5 to 10 mg/dm$^2$.

A silicone rubber layer is provided over the light-sensitive layer. A preferable silicone rubber is linear or suitably somewhat cross-linked organopolysiloxane. The organopolysiloxane has a molecular weight ranging from a thousand to hundreds of thousands, and is appropriately cross-linked to be in a liquid- or paste-like state at room temperature. According to the manner of cross-linkage, the organopolysiloxane can be divided into condensation-type organopolysiloxane and addition-type organopolysiloxane.

The silicone rubber layer, which is adjusted to be hardenable, brings about most excellent results when employed in the present invention.

The organopolysiloxane molecule has the following structure units in its main chain:

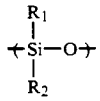

wherein $R_1$ and $R_2$ each represent alkyl, allyl or alkenyl which may contain a substituent such as a cyano radical, a halogen atom and a hydroxyl radical or a combination thereof. Preferred for $R_1$ and $R_2$ are methyl, phenyl, vinyl and trifluoropropyl radical, and especially preferred is methyl radical.

As the cross-linking agent for the organopolysiloxane which gives rise to a condensation reaction are

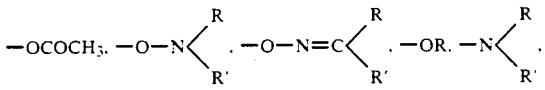

a condensation-type silicone cross-linking agent containing the above radicals (wherein R and R' each represent an alkyle radical) such as de-acetic acid type, de-oxime type, de-alcohol type, de-amino type and dehydration type or a functional radical represented by —OH. The examples of such cross-linking agents include methyltriacetoxy silane, vinyl triacetoxy silane, methyltri(N-methyl, N-acetylamino)silane, vinyltri(methylketooxime)silane and oligomers thereof. Organic carboxylic acids, titanic acid esters and naphthenic acid are employed to promote catalytic function.

The examples of the commercially available silicone rubber are KS-705F (manufactured by Shinetsu Chemical Co., Ltd.), KE-41, 42 and 44 (manufactured by Toshiba Silicone Co., Ltd.), YE5505 and YF3057 (manufactured by Toray Silicone Co., Ltd.), condensation-type silicone rubber such as SH-781, PRX-305 and SH-237; KS-837, KE-103, KE-106 and KE-1300 (manufactured by Shinetsu Chemical Co., Ltd.), TSE-3032 and RTU-B (manufactured by Toshiba Silicone Co., Ltd.) and addition-type silicone rubber such as SH-9555 (manufactured by Toray Silicone Co.).

To improve the mechanical strength of silicone rubber, cross-linking agents such as the preceding silanes and dibutyl tin dilaurate, or an inorganic filler such as silica, titanium oxide and aluminum oxide may be added to the silicone rubber layer. As the filler, silica is preferable. The filler preferably has an average particle size of not more than 500 nm in respect of dispersibility or dispersion stability.

To improve image quality and developability, it is preferred that the thickness of the silicone rubber layer be small. However, to improve press life and to prevent printing contamination, the silicone rubber layer is required to be thick to some extent. Generally, the amount per surface area of the silicone rubber layer is 3 to 50 mg/dm$^2$, preferably 5 to 30 mg/dm$^2$.

EXAMPLES

The present invention will be described in more detail according to the following examples.

EXAMPLE 1

On a corona-treated polyethylene terephthalate base of 100 μm in thickness, a silicone rubber (YF-3057 manufactured by Toshiba Silicone Co., Ltd.) solution of the following composition (Solution A) which contained a composite polymerization inducer consisting of dibutyl tin dilaurate and TSL-8180 (methyltriacetoxy silane manufactured by Toshiba Silicone Co., Ltd.) as the hardenable resin solution, a silicone rubber (YF-3057) solution of the following composition (Solution B) as the unhardenable resin solution and hexane (Solution C) as the solvent were continuously applied by means of a slide hopper over a period of 5 hours in such a manner that the both sides of a coating film layer of Solution A (wet thickness: 1–15 μm) were brought into contact with a coating film layer of Solution B (wet thickness: 2–5 μm) and that of Solution C (3–5 μm), thereby forming a silicone rubber layer with various layer thickness ratios.

During the continuous coating, stuck resin solids (designated as "A" and "B" in FIG. 3) were not formed at either the edge or the ridge of the slide hopper, and longitudinal streak trouble was not observed in the silicone coating layer.

| | Parts by weight |
|---|---|
| Composition of Solution A: | |
| Silicone rubber (YF-3057) | 100 |
| Hexane | 1400 |
| TSL-8180 | 10 |
| Dibutyl tin dilaurate | 0.8 |
| Composition of Solution B: | |
| Silicone rubber (YF-3057) | 100 |
| Hexane | 1400 |
| TSL-8180 | 10 |
| Composition of Solution C: | |
| Hexane | Necessary amount |

COMPARATIVE EXAMPLE 1

Solution D (wet thickness: 20 μm) of the same composition as that of Solution A was continuously applied onto the surface of a support web by means of a slide hopper to form a single coating layer of 1.5 μm in dry thickness. One hour after the start of coating, longitudinal streaks were formed in the coating layer, and coating was stopped to check over the slide hopper. Stuck resin solids formed by the hardening of Solution D were found to be adhering to the edge and ridge of the slide hopper.

| Composition of Solution D: | Parts by weight |
|---|---|
| Silicone rubber (YS-3057) | 100 |
| Hexane | 1400 |
| TSL-8180 | 10 |
| Dibutyl tin dilaurate | 0.8 |

What is claimed is:

1. A method of forming a resin layer on a moving support by a coating device and hardening said resin layer on said support by polymerization, comprising:

(a) conveying said support to pass near said coating device without coming in contact with said coating device, (b) disposing a hardenable resin solution in a form of a hardenable resin layer from said coating device onto said support; said hardenable resin solution having been prepared to start polymerizing by mixing an unhardenable resin solution with a polymerization inducer, said hardenable resin layer having a lower surface which faces said support and an upper surface opposite to said lower surface; and said coating device having a first release point at which said upper surface leaves said coating device and a second release point at which said lower surface leaves said coating device;

(c) overlaying said first release point with a solvent, thereby superimposing a solvent layer on said upper surface of said hardenable resin layer;

(d) overlaying said second release point with an unhardenable resin solution which has not been prepared to start polymerizing; thereby superimposing an unhardenable resin layer on said lower surface of said hardenable resin layer; and applying said superimposed layers onto said support so that a hardened layer is formed on said support.

2. The method of claim 1, wherein said hardenable resin solution, said solvent and said, unhardenable resin solution are applied with a slide hopper.

3. The method of claim 1, wherein said hardenable resin solution, said solvent and said unhardenable resin solution are applied with an extruder.

4. The method of claim 1, wherein said solvent is selected from the group consisting of ketones, alcohols, esters and halogenated hydrocarbons.

5. The method of claim 1, wherein said support includes one selected from the group consisting of polyester, polyolefins, and cellulose derivatives.

6. The method of claim 1, wherein said support comprises metals.

7. The method of claim 6, wherein said metals are selected from the group consisting of Cu, Al and Zn.

8. The method of claim 1, wherein said hardenable resin solution and said unhardenable resin solution comprise a silicone rubber.

9. The method of claim 8, wherein said hardenable resin solution and said unhardenable resin solution further comprise a silane and wherein said polymerization inducer is dibutyl tin dilaurate.

10. The method of claim 1, wherein said hardenable resin solution layer is in amount per surface are of 3 to 50 mg/dm$^2$.

11. The method of claim 1, wherein said polymerization inducer is selected from the group consisting of a polymerization catalyst, a polymerization initiator and a crosslinking agent.

12. The method of claim 11, wherein the polymerization inducer is a crosslinking agent selected from the group consisting of divinyl compounds, aldehydes, urea derivatives, glycols, dicarboxylic acids and diisocyanates.

13. The method of claim 1, wherein the solvent is selected from the group consisting of acetone, methyl ethyl ketone, methyl isobutyl ketone, cyclohexanone, methanol, ethanol, propanol, butanol, methyl acetate, ethyl acetate, butyl acetate, ethyl lactate, ethylene glycol monoacetate, glycol dimethyl ether, glycol monoethyl ether, dioxane, tetrahydrofuran, benzene, toluene, xylene, methylene chloride, ethylene chloride, carbon tetrachloride, chloroform, dichlorobenzene and water.

14. The method of claim 13, wherein the support is selected from the group consisting of polyethylene terephthalate, polyethylene-2,6-naphthalate, polypropylene, cellulose triacetate, cellulose diacetate, polyamide and polycarbonate.

15. The method of claim 13, wherein the hardenable resin solution layer comprises a silicone rubber which is an organopolysiloxane having structural units of the formula

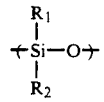

wherein $R_1$ and $R_2$ each represent an unsubstituted alkyl, allyl or alkenyl or an alkyl, allyl or alkenyl substituted by a cyano radical, a halogen atom or a hydroxyl radical.

16. The method of claim 15, wherein $R^1$ and $R^2$ are each methyl, phenyl, vinyl or trifluoropropyl.

17. The method of claim 16, wherein the organopolysiloxane is crosslinked with a crosslinking agent selected form the group consisting of methyltriacetoxy silane, vinyl triacetoxy silane, methyltri(N-methyl, N-acetylamino) silane and vinyltri(methylketooxime) silane.

18. The method of claim 1, wherein the support comprises polyethylene terephthalate; the hardenable resin solution comprises a silicone rubber, dibutyl tin, methyltriacetoxy silane and hexane; the unhardenable resin solution comprises a silicone rubber, hexane and methyltriacetoxy silane; and the solvent comprises hexane.

19. A method of forming a silicon rubber layer on a photosensitive layer formed on a moving support by a coating device and hardening said silicon rubber layer on said photosensitive layer by polymerization, comprising:

(a) conveying said support to pass near said coating device without coming in contact with said coating device;

(b) disposing a hardenable silicon rubber solution in a form of a hardenable silicon rubber layer from said coating device onto said photosensitive layer on said support; said hardenable silicon rubber solution having been prepared to start polymerizing by mixing an unhardenable silicon rubber solution with a polymerization inducer, said hardenable silicon rubber layer having a lower surface which faces said photosensitive layer and an upper surface opposite to said lower surface; and said coating device having a first release point at which said upper surface leaves said coating device and a second release point at which said lower surface leaves said coating device;

(c) overlaying said first release point with a solvent, thereby syuperimposing a solvent layer on said upper surface of said hardenable silicon rubber layer;

(d) overlaying said second release point with an unhardenable silicon rubber solution which has not been prepared to start polymerization, thereby superimposing an unhardenable silicon rubber layer on said lower surface of said hardenable silicon rubber layer; and (e) applying said superimposed layers onto said photosensitive layer on said support so that a hardened silicon rubber layer is formed on said photosensitive layer.

* * * * *